US005709257A

United States Patent [19]

Vinogradov et al.

[11] Patent Number: 5,709,257

[45] Date of Patent: Jan. 20, 1998

[54] REMOVING BARK FROM WOOD CHIPS

[75] Inventors: Viktor N. Vinogradov; Svetlana G. Vinogradova; Leonid P. Zarogatsky; Simon S. Litvin; Vladimir M. Gerasimov; Viktor E. Dubrov, all of St. Petersburg, Russian Federation; Alexander L. Ljubomirsky, Brookline, Mass.; Alexey M. Piniaev, St. Petersburg, Russian Federation

[73] Assignee: Invention Machine Corporation, Boston, Mass.

[21] Appl. No.: 714,885

[22] Filed: Sep. 13, 1996

[51] Int. Cl.[6] ..... B27L 1/00

[52] U.S. Cl. ..... 144/341; 144/162.1; 144/176; 144/180; 144/208.1; 241/244

[58] Field of Search ..... 241/221, 244, 241/248, 254, 259.1; 144/2.1, 162.1, 176, 180, 341, 208.1

[56] References Cited

U.S. PATENT DOCUMENTS

| | | | |
|---|---|---|---|
| 3,746,269 | 7/1973 | Maier | 241/244 |
| 3,759,304 | 9/1973 | Lundmark et al. | 144/176 |
| 3,790,092 | 2/1974 | Reinhall | 241/244 |
| 4,002,300 | 1/1977 | Mruck et al. | 241/244 |
| 4,081,146 | 3/1978 | Yagi | 241/244 |
| 4,964,447 | 10/1990 | Farrell et al. | 144/180 |

*Primary Examiner*—W. Donald Bray
*Attorney, Agent, or Firm*—Edward Dreyfus, Esq.

[57] ABSTRACT

A method of crushed ground-wood processing comprises charging the input between two relatively revolving and displaced conical surfaces with simultaneous dimension separation variation by circulating vibrations causing the surfaces to apply variable squeezing pressure and lateral or normal forces to effectively compress and rub the bark from the wood surface.

9 Claims, 1 Drawing Sheet

REMOVING BARK FROM WOOD CHIPS

The present invention relates to the field of timber processing industry and may be used to prepare wood chips and for further working from crushed timber, especially from low quality logging wood waste or small wood fraction.

BACKGROUND

One of the main tasks in paper making, especially for high quality paper, is to prepare the chip to have low bark fraction content because presence of same reduces the paper mechanical strength and raises the paper contamination. The chip preparation from the barked timber-wood yields the best results. But using the timber-wood tends to raise paper cost and, also, there is a deficit or depletion of such raw material at the present time. Accordingly, there is interest to develop other material sources such as fuel-wood, logging wood waste, and of quantities of tiny wood parts for such utilization. In this case, there is need for bark and wood fraction separation at the raw material stage and, while tiny wood parts can be used, there is a problem of primarily separating bark from wood branches.

The raw material needed for such processing is crushed ground-wood that consists of clean ships, bark pieces and unbarked chips fractions. As a rule, such ground-wood also contains some sawdust and needles.

As a rule, the base of conventional clean chip production methods from the above stated raw materials includes mechanically crushed bark fraction and the further ground-wood separated by dimension or specific weight of bark and uncrushed chip fraction.

For example, according to prior method, U.S. Pat. No. 4,616,785; Ser. No. 403,487 filed Jul. 30, 1982, the crushed ground-wood and the great amount of steel globules are charged into rotating drum. The drum rotates to impact and crush the bark into granules. Separation by dimensions is realized at the outlet, largest granules are recycled into the drum, uncrushed bark is moved to a special bin and crushed bark with primarily sawdust and part of crushed wood exit through the sieve and are removed to wastes by a conveyer. This prior method, however, requires too much energy, achieves only a small productivity or through-put and does not solve the problem of "bark-tiny wood" separation.

The increasing demand for processed wood materials leads to the early harvesting of trees. Accordingly, many branches and small trunks are presented for processing which has led, as a result, to losses and great mechanical damage of processing the uncrushed wood. This, in turn, leads to the reduction of quality of technically prepared raw materials.

In another prior method, Finland Pat. No. 208/63, bark grinding is realized by means of multi-pressure upon ground-wood between rollers with serrated surfaces. The characteristic features of this method are the processing of a great amount of grown small and damaged wood.

In another prior method known to Applicants the crushed ground-wood is charged into the cavity between two relatively revolving disks with serrated surfaces. Ground-wood is crushed by means of grinding. Because of the lower mechanical strength than that of wood fiber, the bark is ground smaller than the wood chips. Thereafter, the bark and ground-wood are separated by a twin basket chip screen according to their dimensions. This method has the same disadvantages as aforementioned U.S. and Finnish patents, namely, the large ground-wood losses at the large cell sieve and poor degree of bark grinding, damage of ground-wood by the high load while trying to increase bark grinding into small pieces.

Note that in all above methods there remains a significant amount of chips bearing bark and, for that reason, those methods are inefficient for tiny wood processing.

SUMMARY OF THE INVENTION

The technical objects of applying the method of the present invention include the removal of the bark from the wood chips and reducing the size of bark fraction that is contained in the primary crushed ground-wood and separating the same while processing without damaging wood chips.

According to the present invention, the method of crushed ground-wood processing comprises charging the input between two relatively revolving and displaced surfaces with further dimension separation variation by circulating vibrational rolling over the ground-wood by such surfaces.

The technical results achieved by the present method include increase in the wood chip fraction output, reduction of required power, and the high efficiency processing of tiny wood. This result is achieved by a different mechanism for material crushing than used in conventional methods. Conventional methods, described above, generally apply influence on and crushing the layer of ground-wood by contacting with surfaces comprising globules, serrated rollers, or a serrated grinder whereas the present method crushes the entire volume of ground-wood. Thanks to smooth (without lags) processing surfaces, the ground-wood contacted by these surfaces of the present invention is not crushed and an equal force load is provided through the entire processed layer and the vibrational movement of one of the surfaces provides first the proportional and gradual crushing of bark fraction, and second, the rubbing of bark laterally off the ground-wood from the outer layer of the wood.

BRIEF DESCRIPTION OF THE DRAWINGS

The only FIGURE comprises a pictorial, vertical cross section of apparatus for implementing the inventive process.

DETAILED DESCRIPTION OF ONE EMBODIMENT OF THE INVENTION

Figure 1:
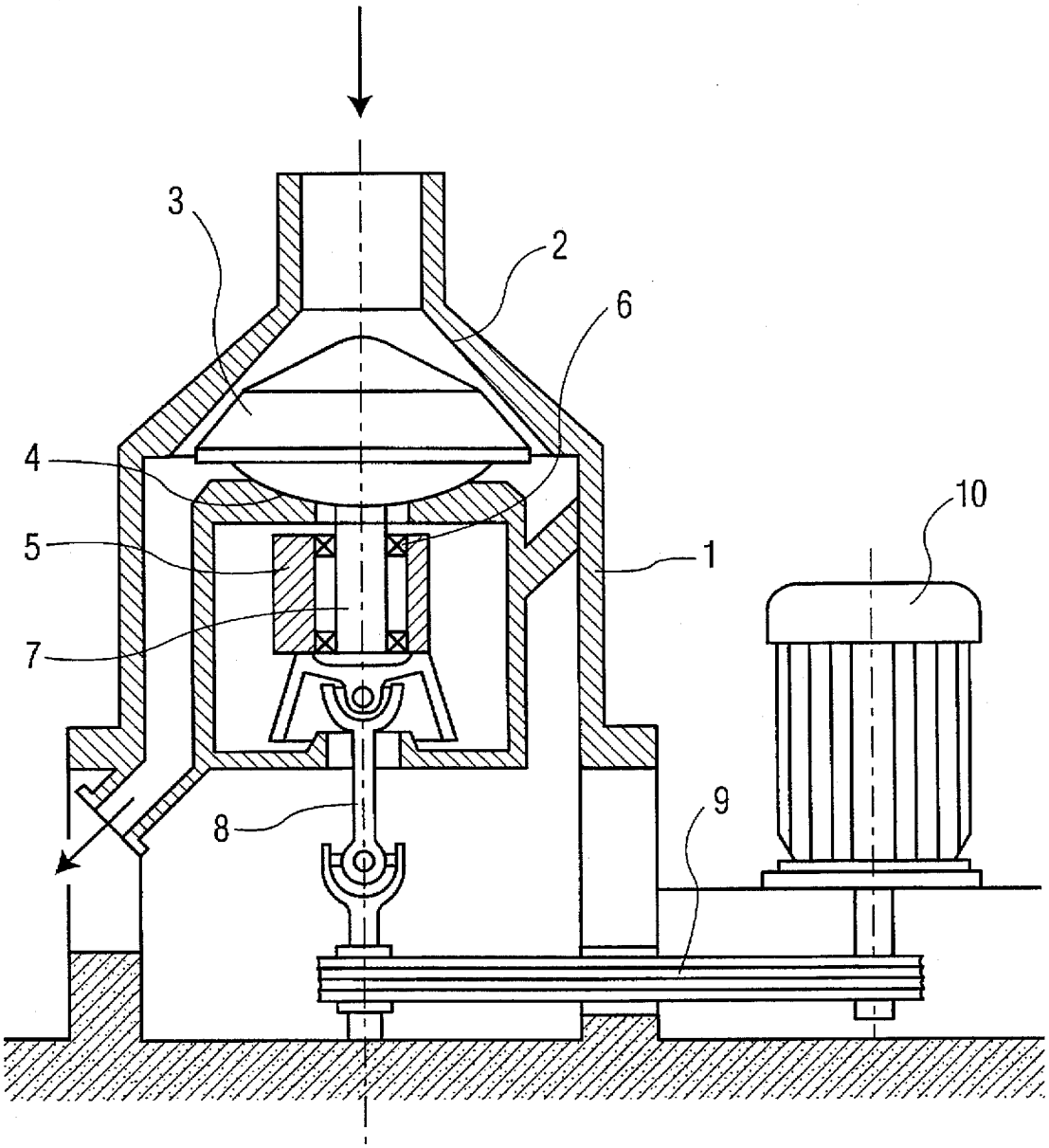

One exemplary apparatus that can be used in the present inventive process is known as a tapered inertial crusher or rotating inertial cone crusher. Typically, this apparatus includes housing 1 with inlet and outlet openings. In the operating chamber of housing 1 the inner surface 2 is shaped as a cone widening toward the lower part of the chamber. Within housing 1 is placed a cone shaped operating body 3, positioned on spherical support 4 and supplied by unbalanced vibrator 5 with displaced center of gravity, mounted on shaft 7 and bearing 6. Perferably, the surfaces of the body 3 and inner surface 2 are smooth, i.e. without lags. Vibrator 5 is connected to motor 10 by cardan shaft 8 and V-belt transmission 9.

The inventive process is carried out as follows. Motor 10 rotates via V-belt transmission 9 and cardan shaft 8. The increased centrifugal force compels the operating body 3 to perform spherical pendulum gyrations on spherical support 4 in relation to the sphere center. The ground-wood to be processed is fed from the top to the inlet opening of housing 1. Because of its own mass or weight and pressure, the lower portion of the ground-wood enters the gap between operating surfaces 2 of housing 1 and operating body 3. While the moving through this gap, the formed layer of ground-wood is influenced by impulse forces of pressure and shift, or rubbing, because of operating body 3 rolling over that layer.

Accordingly, the increased force of shift or rubbing is directed normally to force of pressure developed between the two surfaces. Under this vibration action, the chip particles that formed the ground-wood layer are oriented plane-to-plane, thereby achieving high efficiency of rubbing out off bark from the ground-wood.

After passing the operating chamber, the ground-wood is discharged and sorted by the usual method, for instance, by means of a gyration or hanging type of sorter.

The operating chamber comprises a circular space between coaxial revolving cones. The inner cone forms the spherical pendulum with vibration drive and allows, as compared to known arrangements, to change movement direction in relation to that of the operating surfaces. This feature leads to a great increase of productivity.

The operating chamber cone cross-section helps to size the chips that pass through and apply the gradual rubbing off action to the chips which causes the plane-to-plane orientation of chip particles and thereby achieves the efficient rubbing off of the bark. Thus, the gradual reduction in cross-section of the low part of operating chamber provides the zone of final bark rubbing off the ground-wood at higher specific pressures than at the upper part of the chamber.

The multiaction of pressing and rubbing on the chip enables bark removal at significantly lower pressure, which therefore avoids destruction of the wood part of the chip.

Note that the inertia cone crusher normally functions to grind materials with very high hardness, which also destroys by impact the material weakest intercristal surfaces and structure defects.

In the present invention, the crusher is used for another purpose, i.e., for soft material as crushed ground-wood there is achieved another effect, at the moment of pressure, namely, the supplemental shift or rubbing forces. The above mentioned technical result is achieved because of the application of both sets of forces.

We claim:

1. A method of removing bark from wood chips comprising:

charging wood chips bearing bark between two surfaces, relatively moving said surfaces in a first direction to apply squeezing pressure to the wood chips bearing bark, simultaneously with said squeezing pressure relatively moving said surfaces in a second direction to apply rubbing forces to said wood chips bearing bark, said rubbing forces being directed substantially normal to said first direction.

2. The method according to claim 1, wherein said surfaces have portions that extend progressively closer to each other to apply increasing pressure and increasing rubbing force to said wood chips bearing bark.

3. The method according to claim 1, wherein said surfaces are continuous.

4. The method according to claim 1, further comprising vibrating one of said surfaces in said first direction to vary said squeezing pressure and rubbing force.

5. The method according to claim 1, wherein both said surfaces are substantially smooth.

6. The method according to claim 1, wherein the maximum squeezing pressure is limited to below the value that would adversely crush the wood portion of the wood chips bearing bark.

7. The method according to claim 1, wherein both surfaces comprise concentric conical portions and wood chips bearing bark are charged at the smaller end of said conical portion and wood chips free of bark and removed bark elements are discharged from the larger end of said conical portions.

8. The method according to claim 7, comprising maintaining the outer conical surface stationary and rotating the inner conical surface.

9. The method according to claim 8, comprising vibrating the inner conical surface toward and away from the stationary conical surface during the rotation of the inner conical surface.

* * * * *